US007328465B1

(12) United States Patent
Morad

(10) Patent No.: US 7,328,465 B1
(45) Date of Patent: Feb. 12, 2008

(54) TOILET SEAT COVER MADE OF A DISPOSABLE PAPER SHEET CONTAINING FINGER HOLES TO FACILITATE EASY TEARING OFF A CENTER PORTION OF THE SHEET

(75) Inventor: Fred I. Morad, Toluca Lake, CA (US)

(73) Assignee: Worldwide Integrated Resources, Inc., Montebello, CA (US)

( * ) Notice: Subject to any disclaimer, the term of this patent is extended or adjusted under 35 U.S.C. 154(b) by 0 days.

(21) Appl. No.: 11/605,795

(22) Filed: Nov. 29, 2006

Related U.S. Application Data

(63) Continuation-in-part of application No. 11/479,465, filed on Jun. 30, 2006, now Pat. No. 7,254,845.

(51) Int. Cl.
*A47K 13/14* (2006.01)
*A47K 13/163* (2006.01)

(52) U.S. Cl. ..... 4/245.3; 4/245.9

(58) Field of Classification Search ..... 4/244.1–245.9
See application file for complete search history.

(56) References Cited

U.S. PATENT DOCUMENTS

| | | | | |
|---|---|---|---|---|
| 1,248,077 | A | 11/1917 | Ennis | |
| 1,452,552 | A | 4/1923 | Frear | |
| 1,702,070 | A | 2/1929 | Young | |
| 1,761,391 | A | 6/1930 | Harris | |
| 1,847,131 | A * | 3/1932 | Moore | 4/244.1 |
| D174,213 | S | 3/1955 | Brito | |
| 2,984,383 | A * | 5/1961 | Arneson | 206/184 |
| 4,264,992 | A | 5/1981 | Tromp | |
| 4,766,617 | A * | 8/1988 | Thygesen et al. | 4/245.4 |
| 4,875,242 | A | 10/1989 | Albrechet et al. | |
| D320,069 | S | 9/1991 | Rossiter | |
| D451,178 | S | 11/2001 | Massey | |
| 6,968,578 | B2 | 11/2005 | Bernsley | |

FOREIGN PATENT DOCUMENTS

| | | |
|---|---|---|
| EP | 0628278 | 12/1994 |
| WO | WO 99/34720 | 7/1999 |

* cited by examiner

*Primary Examiner*—Huyen Le
*Assistant Examiner*—Kristie A. Mahone
(74) *Attorney, Agent, or Firm*—Thomas I. Rozsa

(57) ABSTRACT

The present invention relates to a generally rectangular shaped disposable paper sheet for use as a toilet seat cover, comprising a die cut line shaped as an open ended oval, which divides the sheet into a central elongated ovally shaped portion and an outer seat covering portion. A pair of finger holes are cut into the central portion of the paper sheet so that, when the finger holes are used to tear the die cut line, the entire central portion can be easily torn downwardly away from the outer covering portion which rests on and covers the toilet seat. The holes are not cut in a full 360 degree circle but have a portion that is retained onto the central portion of the cover.

7 Claims, 3 Drawing Sheets

TOILET SEAT COVER MADE OF A DISPOSABLE PAPER SHEET CONTAINING FINGER HOLES TO FACILITATE EASY TEARING OFF A CENTER PORTION OF THE SHEET

This patent application is a continuation-in-part of patent application Ser. No. 11/479,465 filed on Jun. 30, 2006 now U.S. Pat. No. 7,254,845.

BACKGROUND OF THE INVENTION

1. Field of the Invention

The present invention is related to a disposable paper sheet used as a toilet seat cover for sanitary purpose.

2. Description of the Prior Art

The following 1.3 patents and published patent applications are the closest prior art references which are related to the present invention.

1. U.S. Pat. No. 1,284,077 issued to Luna May Ennis on Nov. 5, 1918 for "Sanitary Seat Cover For Toilets" (hereafter the "Ennis Patent");

2. U.S. Pat. No. 1,452,552 issued to Leo J. Frear on Apr. 24, 1923 for "Sanitary Seat Cover" (hereafter the "Frear Patent");

3. U.S. Pat. No. 1,702,070 issued to Thomas L. Young on Feb. 12, 1929 for "Sanitary Toilet Seat Cover" (hereafter the "Young Patent");

4. U.S. Pat. No. 1,761,391 issued to Clara F. Harris on Jun. 3, 1930 for "Sanitary Shield For Toilet Seats" (hereafter the "Harris Patent");

5. United States Design Patent No. Des. 174,213 issued to Jose Brito on Mar. 15, 1955 for "Disposable Paper Toilet Seat Cover" (hereafter the "Brito Design Patent");

6. U.S. Pat. No. 4,264,992 issued to Geradus M. Tromp on May 5, 1981 for "Paper Sheet Cartridge" (hereafter the "Tromp Patent");

7. U.S. Pat. No. 4,766,617 issued to Eskild G. Thygesen et al. on Aug. 30, 1988 for "Disposable Sanitary Toilet Seat Cover" (hereafter the "Thygesen Patent");

8. U.S. Pat. No. 4,875,242 issued to Leonard N. Albrecht et al. and assigned to Alvin S. Haining et al. on Oct. 24, 1989 for "Compact Toilet Seat Cover" (hereafter the "Albrecht Patent");

9. United States Design Patent No. Des. 320,069 issued to Jean T. Rossiter on Sep. 17, 1991 for "Toilet Seat Cover" (hereafter the "Rossiter Design Patent");

10. United States Design Patent No. D451,178 issued to William Yates Massey, Jr. on Nov. 27, 2001 for "Portable Toilet Seat Cover" (hereafter the "Massey Design Patent");

11. U.S. Pat. No. 6,968,578 issued to Mark Bernsley on Nov. 29, 2005 for "Child's Disposable Toilet Seat Adaptor With Side Handles And Fold-Under Flap" (hereafter the "Bernsley Patent");

12. European Patent Application No. 0,628,278 issued to Walter J. Breyer and assigned to Scott Paper Company on Dec. 14, 1994 for "Flushable, Laminated Toilet Seat Cover" (hereafter the "Breyer European Patent Application");

13. International Application No. WO 99/34720 issued to Josef Kodet et al. on Jul. 15, 1999 for "Sanitary Toilet Seat Cover" (hereafter the "Kodet International Application").

The Ennis Patent which issued in 1918 is a seat cover for toilets. It discloses slot cut portions B which can be used to separate the center section from the body of the cover.

The Frear Patent which issued in 1923 is also a roll of sanitary covers which is attached to the toilet and which can be pulled by tabs 8 to remove one seat cover from the roll of seat covers.

The Young Patent which issued in 1929 is a sanitary toilet seat cover which has flaps which are designed to hang onto the interior of the bowl to facilitate the carrying away of the cover in the flushing operation.

The Harris Patent which issued in 1930 is also a sanitary cover. It discloses a use of tabs 20 by which the seat cover may be removed from the toilet seat after use.

The Brito Patent which issued in 1955 is a design patent which protects the shape of a toilet seat cover.

The Tromp Patent is a paper sheet cartridge which discloses having longitudinally extending slits 35 and 37 forming a curve out of portion 39 and a central tongue 41. There are two slits 57 and 58 shown but these don't serve any functional purpose.

The Thygesen Patent which issued in 1988 discloses a disposable sanitary toilet seat cover. It discloses a finger hole 6 which can be used for gripping in the process of tearing off the central potion. However, the disadvantage of the Thygesen invention is that the finger hole is located on the edge of the central portion which is bounded by a die cut line, wherein a part of the edge of the finger hole is aligned with the die cut line. Therefore, the finger hole disappears once it is used to tear a portion of the interior section of the die cut line away from the remainder of the toilet seat cover.

The Albrecht Patent discloses a compact toilet seat cover which includes a small piece of tape 58 and a protective liner 62.

The Rossiter Patent discloses the design for a toilet seat cover.

The Massey Patent is a design patent, which discloses a portable toilet seat cover. There is a groove which is shown at the bottom but is unclear what purpose it serves.

The Bernsley Patent is a disposable toilet seat cover which has more of a solid cover designed so that a child can sit in the toilet and not fall in.

The Breyer European Patent Application discloses a flushable toilet seat cover which can dissolve when it falls into the toilet seat.

Finally, the Kodet International Patent Application discloses a sanitary toilet seat cover which consists of two water soluble layers so that it can dissolve in the toilet.

There is a significant need to significantly improve the ability to tear away the center portion of a die cut toilet seat cover.

SUMMARY OF THE INVENTION

The present invention relates to a generally rectangular shaped disposable paper sheet for use as a toilet seat cover, comprising a die cut line shaped as an open ended oval, which divides the sheet into a central elongated ovally shaped portion and an outer seat covering portion. More particularly, the present invention, as one preferred embodiment, relates to an addition of a pair of finger holes into the central portion of the paper sheet so that, when the finger holes are used to tear the die cut line, the entire central portion can be easily torn downwardly away from the outer covering portion which rests on and covers the toilet seat. In another preferred embodiment of the present invention, a reinforcement is applied around the finger holes to make them stronger so that they will not tear when the force of the fingers is applied to tear the die cut portion away from the seat cover portion. In yet an additional preferred embodiment of the present invention, a pair of added finger holes are not cut in a full 360 degree circle but have a portion that is retained onto the central portion of the cover, so that the portion is retained with the interior of the seat cover to increase the strength of the finger holes, which results in a more easy tearing off of the central die cut portion of the toilet seat cover.

It has been discovered, according to one preferred embodiment of the present invention, that if a pair of finger holes are placed into a central elongated ovally shaped portion of a generally rectangular paper sheet which is used as a toilet seat cover, wherein the central portion is bounded by a die cut line shaped as an open ended oval and the paired holes are placed transversely to an imaginary centerline of the sheet, the central portion of the sheet will be more easily and entirely torn along the die cut line, when the paired finger holes are used to tear the center portion away from the outer seat covering portion.

It has also been discovered, according to an another preferred embodiment of the present invention, that if the paired finger holes placed into the central portion of the sheet are reinforced around the holes, it makes the reinforced finger holes stronger so that they will not tear when force is applied to the holes.

It has further been discovered, according to an additional preferred embodiment of the present invention, that if a pair of finger holes placed into the central portion of the sheet are not cut in a full 360 degree circle but have a portion that is retained onto the central portion of the cover, then the portion which is retained with the interior of the seat cover increases the strength of the finger holes, which thereby results in a more easy tearing off the central die cut portion of the toilet seat cover when the paired finger holes are used to tear the central portion off the cover sheet. This alternative embodiment can also be incorporated into an embodiment having at least one finger hole.

It has been additionally discovered, according to the present invention, that if at least one finger hole is placed into a central portion of a generally rectangular paper sheet which is used as a toilet seat cover, wherein the central portion is determined by a die cut line shaped as an open ended oval and the at least one finger hole is placed transverse to an imaginary centerline of the elongated sheet, the central portion of the sheet will be more easily and entirely torn from the die cut line when a finger is inserted into at east one hole and to tear the central portion away from the covering portion.

It has further been discovered, according to the present invention, that if the at least one finger hole placed into the central portion of the sheet is reinforced around the hole, it makes the reinforced finger hole stronger so that it will not tear.

It is therefore an object of one preferred embodiment of the present invention to provide a pair of finger holes placed into a central elongated ovally shaped portion of a generally rectangular paper sheet which is used as a toilet seat cover, wherein the central portion is bounded by a die cut line shaped as an open ended oval and the paired holes are placed transversely to an imaginary centerline of the sheet so that the central portion of the sheet will be more easily and entirely torn along the die cut line when the paired finger holes are used to tear center portion away from the outer seat covering portion.

It is also an object of the present invention in accordance with an another preferred embodiment to provide reinforcement around the pair of finger holes which are placed into the central portion of the sheet, to thereby make the reinforced finger holes stronger so that they will not tear when force is applied to the holes.

It is a further object of the present invention to provide a pair of finger holes placed into the central portion of the sheet which are not cut in a full 360 degree circle but have a portion that is retained onto the central portion of the cover, so that the portion which is retained with the interior of the seat cover increases the strength of the finger holes, which results in more easy tearing off of the central die cut portion of the toilet seat cover when the paired finger holes are used to tear the central portion off the cover sheet. This alternative embodiment can also be incorporated into an embodiment having at least one finger hole.

It is an additional object of the present invention to provide at least one finger hole placed into a central portion of a generally rectangular paper sheet which is used as a toilet seat cover, wherein the central portion is bounded by a die cut line shaped as an open ended oval and the at least one hole is placed adjacent an imaginary centerline of the elongated sheet so that the central portion of the sheet may be more easily and entirely torn from the die cut line, when the at least one finger hole is used to tear the central portion away from the outer seat covering portion.

It is a further object of the present invention to provide reinforcement around the at least one finger hole which is placed into the central portion of the sheet to thereby make the reinforced finger hole stronger so that it will not tear.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention in accordance with one preferred embodiment is an improvement to resolve deficiencies in prior art toilet seat covers by adding a pair of finger holes into a central portion of a die cut paper sheet which is used as a toilet seat cover to enable the central portion to be effectively gripped by insertion of one or two fingers of a hand into a respective finger hole to apply a force to the sheet so that the entire central portion can be easily and quickly torn away from rest of the sheet. Variations of the structural features of the preferred embodiment are included for enhancing of strength of the pair of finger holes. This includes applying external materials to reinforce the holes and changing the hole structure from a full 360 degree circle to a partially cut circle so that a retained portion of each of the holes will be retained on the interior of the seat cover to increase the strength of the holes.

Figure 1:
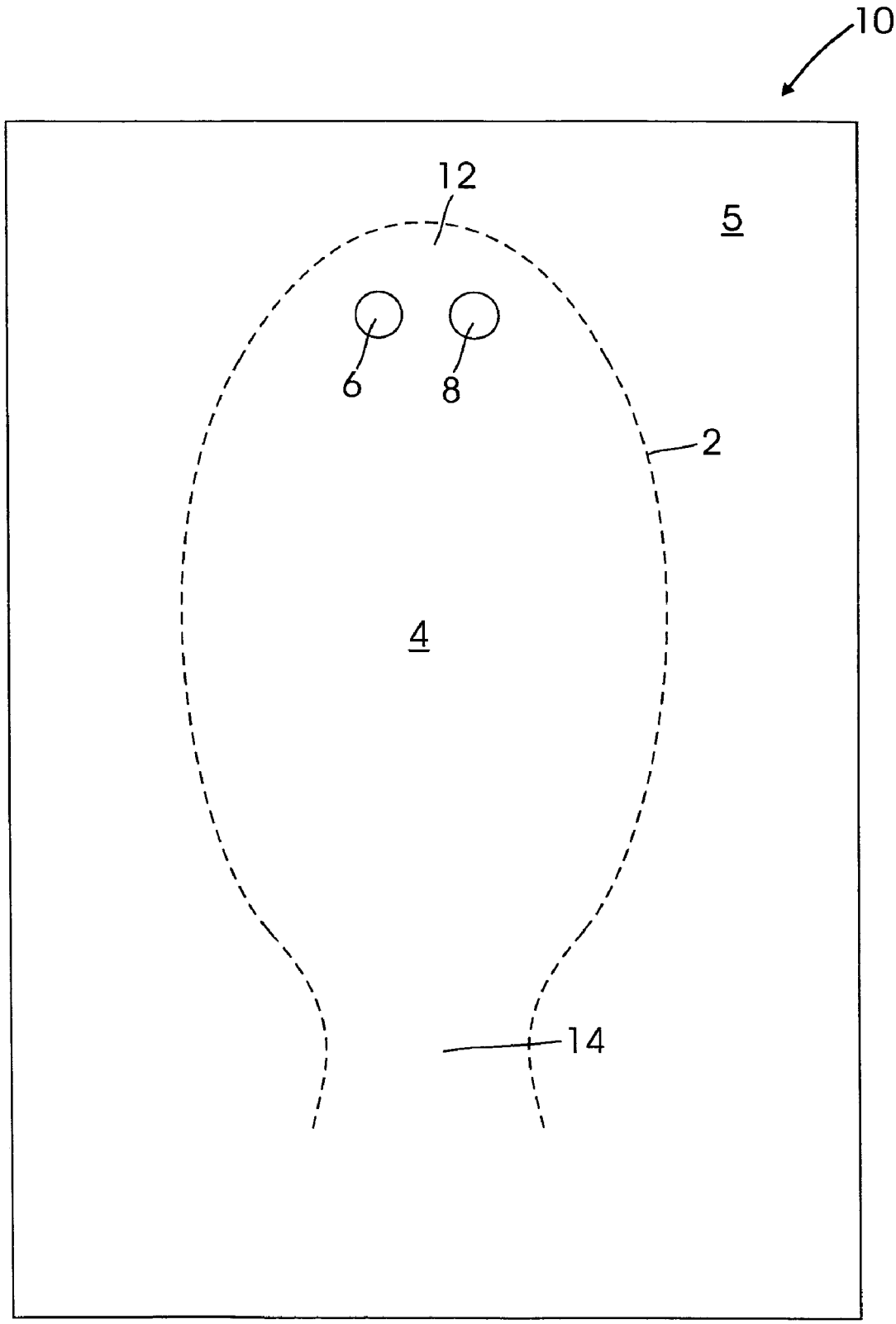
FIG. 1 is a plan view of the present invention paper sheet for use as a toilet seat cover according to one preferred embodiment of the invention wherein a pair of finger holes are placed into a central portion of the sheet.

Referring to FIG. 1, there is illustrated one preferred embodiment of the present invention improved disposable paper sheet 10 used as a toilet seat cover wherein the improvement is an addition of finger holes in the central portion which lies within the die cut area to facilitate easily tearing off of the central portion from the remainder of the sheet. In one preferred embodiment, the sheet 10 has a generally rectangular shape, comprising a die cut line 2 shaped as an open ended oval, wherein the die cut line comprises a plurality of fine discrete slits with a fine distance between two adjacent slits. The die cut line 2 further defines a central elongated ovally shaped portion 4, and an outer seat covering portion 5 of the paper sheet 10. The central portion comprises an oval area 12 and a distal section 14 along a longitudinal direction of the elongated ovally shaped central portion 4.

Referring further to FIG. 1, a pair of finger holes 6 and 8 are preferably located transversely and symmetrically along an imaginary centerline of the elongated central portion 4, wherein the imaginary centerline is further aligned with a longitudinal centerline of the rectangular sheet 10. The pair of finger holes 6 and 8 are further illustrated to preferably be located close to the oval end 12 of the central portion 4. With the presence of the finger holes, the user can grip the finger holes 6 and 8 by placing a respective one or two fingers into a respective finger hole and apply a force to separate the entire central elongated ovally shaped portion 4 away from the outer seat covering portion 5 through tearing the die cut line 2. The outer seat covering portion then can be placed to rest on and cover the toilet seat, while the central portion 4 with the oval end 12 extends downwardly into a toilet bowl while the distal section 14 links the central portion 4 to the outer seat covering portion 5. The central elongated ovally shaped portion also serves to carry the sheet off when the toilet is flushed, wherein the paper sheet used in the present invention is a preferred type suitable for flushing after use so that the entire paper sheet can be disposed into the toilet.

Figure 2:
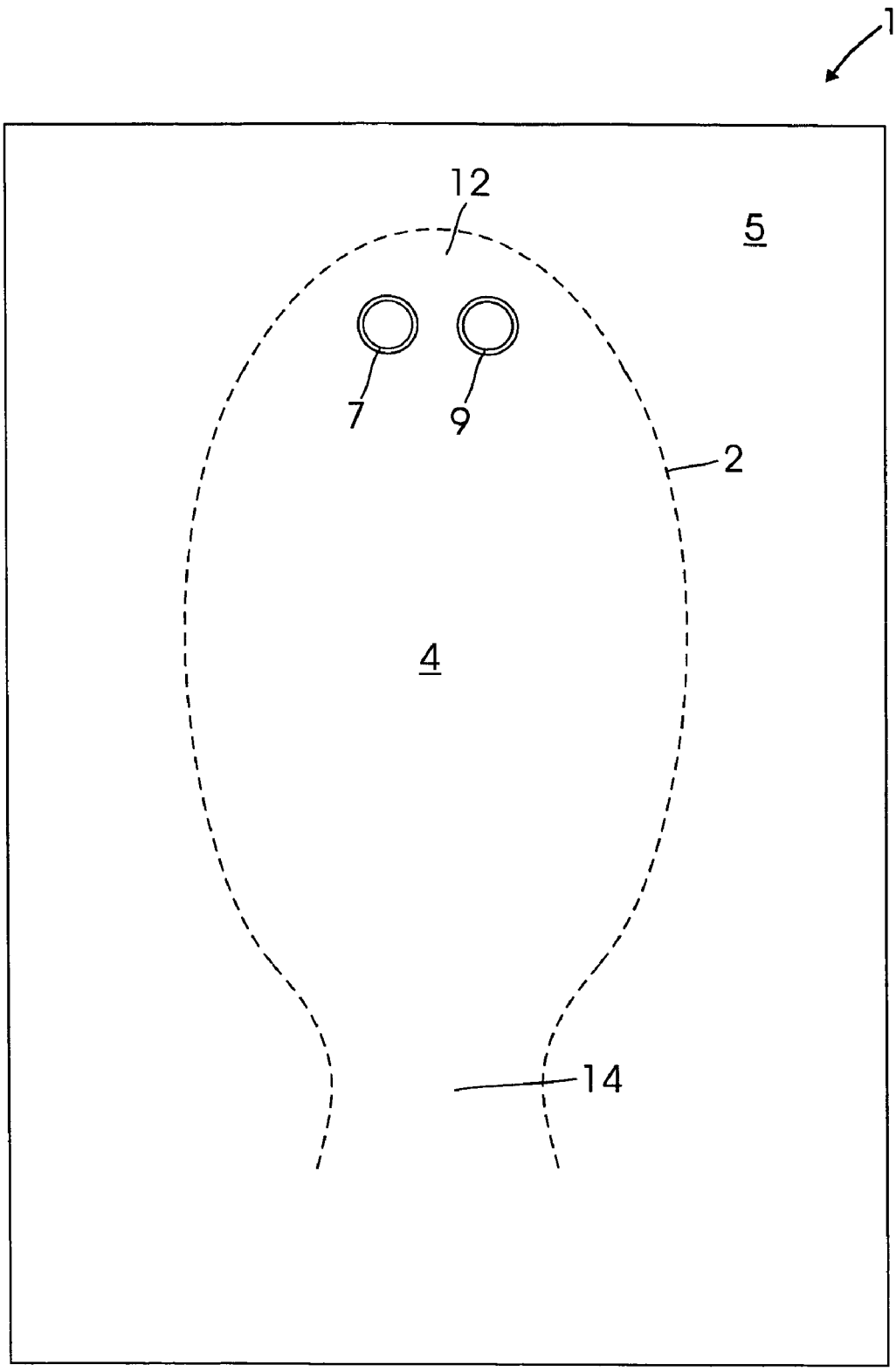
FIG. 2 is a plan view of the present invention paper sheet for use as a toilet seat cover according to an another preferred embodiment of the invention wherein a pair of finger holes with reinforcements around the holes are placed into a central portion of the sheet.

Referring to FIG. 2, there is illustrated an another preferred embodiment of the present invention improved disposable paper sheet 10'. As illustrated, a reinforcement is applied around each of the paired holes, which makes the reinforced finger holes 7 and 9 stronger, so that they will not tear when the force is applied to the holes.

It will be appreciated that the reinforcement to the finger holes can be achieved through mechanical and chemical methods. As an example of a mechanical reinforcement, additional layers of the same type or different types of paper sheets can be added onto areas around the finger holes. As an example of chemical reinforcement, a plastic film can be coated onto the paper sheet around the finger holes. It will be further appreciated that the reinforcement not only can be separately applied to each respective finger hole, but also can be applied to both finger holes so that the reinforcement can be an integral part of the toilet seat cover.

Figure 3:
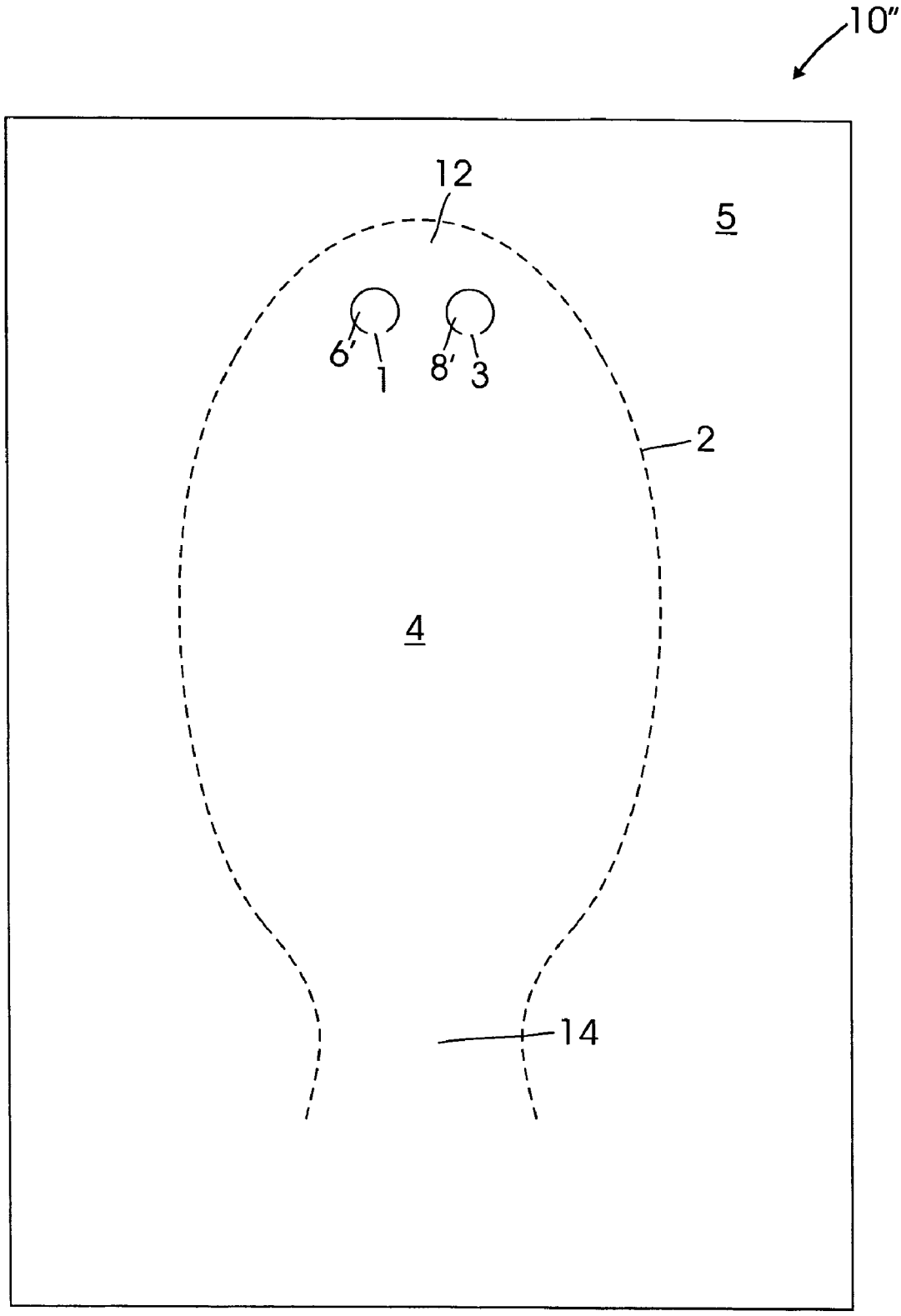
FIG. 3 is a plan view of the present invention paper sheet for use as a toilet seat cover according to an additional preferred embodiment of the invention, wherein the preferred embodiment uses a pair of finger holes which are not cut in a full 360 degree circle but have a portion that is retained within the interior of the seat cover.

In addition to the above mentioned variations of the preferred embodiments 10', an additional preferred variation of the present invention improved disposable paper sheet 10" is illustrated in FIG. 3 for use as the toilet seat cover. The pair of added finger holes 6' and 8' are not cut in a full 360 degree circle but have a respective portion 1 and 3 that is retained onto the interior 4, so that the portions are retained with the interior 4 of the seat cover to increase the strength of the respective finger holes 6' and 8' when a force of fingers is applied to the holes, which results in a more easy tearing off of the central die cut portion of the toilet seat cover 10". It will be appreciated that the size 1 and 3 can be varied but their maximum width is expected not to exceed a size of the radius of the holes 6' and 8' in accordance with the object to quickly tear down the central portion 4 of the toilet paper sheet 10".

With respect to the above description, it is to be realized that variations in size, shape, structural feature, and dimensional location are readily available for the present invention. Therefore, it will be appreciated that the presently invented paper sheet for use as the toilet seat cover is not limited to be the rectangular shape. For example, an annular shape is also effective. Any shape of the paper sheet can be effective for the present invention as long as the outer seat covering portion can rest on and cover the toilet seat. For the same reason, the central portion of the paper sheet is not limited to be the oval shape but can be any appropriate shapes, such as a "U" shape.

It will be further appreciated that pair of finger holes are not limited to be located close to the oval end of the central portion of the paper sheet. The finger holes can be located at any location in the central portion 4 as long as the central portion can be easily and quickly torn from the outer seat covering portion 5 when the finger holes are used for the tearing purpose. The finger holes should be in the body portion 4 and not adjacent the die-cut line 2 because placing the holes adjacent to the die-cut line will cause the hole to disappear once the central portion 4 is torn away from the die-cut line 2.

It will also be appreciated that it is within the spirit and scope of the present invention to have at least one finger hole in the central portion 4 to effectively separate the central portion 4 from the outer seat covering portion 5 of the paper sheet 10. The variation of the at least one finger hole includes the embodiment where the hole is not cut in a full 360 degree circle and a portion of the cut is retained with the interior of the toilet seat cover.

Defined in detail, the present invention is a paper sheet used as a toilet seat cover, comprising: (a) a generally rectangular shaped sheet of paper which is suitable for flushing into a toilet after use and having a die cut line shaped as an oval that divides the paper sheet into a central elongated ovally shaped portion and an outer seat covering portion; (b) the central elongated ovally shaped portion comprises an oval area and a distal section, with a pair of spaced apart finger holes transversely extending through the oval area and symmetrically located along an imaginary longitudinal centerline of the oval area and further close to an end of the oval area remote from the distal section, the imaginary longitudinal centerline is further aligned with a longitudinal centerline of the paper sheet, each finger hole is not cut in a full 360 circle but has a portion that is retained onto the central elongated ovally shaped portion of the paper sheet to increase the strength of the finger holes; and (c)

through use of a respective one or two fingers of a hand, the finger is respectively inserted into a respective one of the finger holes and used to tear the oval area along the die-cut line to separate the oval area from the remainder of the sheet, so that when the covering portion is placed over a toilet seat, the elongated oval area hangs down into a toilet bowl and remains connected to the covering section by its distal section.

Defined more broadly, the present invention is a paper sheet used as a toilet seat cover, comprising: (a) a sheet of paper having an interior die cut line which divides the paper sheet into a central portion within the die-cut line and an outer seat covering portion; (b) the central portion comprises a body area and a distal section, with a pair of spaced apart finger holes transversely extending through the body area, with each finger hole not cut in a full 360 degree circle but has a portion retained onto the body area; and (c) through use of a respective one or two fingers of a hand, the finger is inserted into a respective one of the finger holes and used to tear the body area along the die-cut line to separate the body area from the remainder of the sheet, so that when the covering portion is placed over a toilet seat, the body area hangs down into a toilet bowl and remains connected to the covering section by its distal section.

Defined most broadly, the present invention is a paper sheet used as a toilet seat cover, comprising: (a) a sheet of paper having an interior die cut line which divides the paper sheet into a central portion within the die-cut line and an outer seat covering portion; (b) the central portion comprises a body area and a distal section, with at least one finger hole transversely extending through the body area with the at least one finger hole not cut in a full 360 degree circle but having a portion retained onto the body area; and (c) through use of a finger of a hand, the finger is inserted into the at least one finger hole and used to tear the body area along the die-cut line to separate the body area from the remainder of the sheet, so that when the covering portion is placed over a toilet seat, the body area hangs down into a toilet bowl and remains connected to the covering section by its distal section.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A paper sheet used as a toilet seat cover, comprising:

a. a generally rectangular shaped individual sheet of paper which is suitable for flushing into a toilet after use and having a die cut line shaped as an oval that divides the paper sheet into a central elongated ovally shaped portion and an outer seat covering portion;

b. said central elongated ovally shaped portion comprises an oval area and a distal section, with a pair of spaced apart finger holes transversely extending through the oval area and symmetrically located along an imaginary longitudinal centerline of the oval area and further close to an end of the oval area remote from the distal section, the pair of spaced apart finger holes positioned at a location so that the finger holes are not connected to the die cut line and do not touch the die cut line, said imaginary longitudinal centerline is further aligned with a longitudinal centerline of said paper sheet; each finger hole is not cut in a full 360 degree circle but has a portion that is retained onto the central elongated ovally shaped portion of the paper sheet to increase the strength of the finger holes; and c. through use of fingers of a hand, the finger is respectively inserted into a respective one of the finger holes and used to tear the oval area along the die-cut line to separate the oval area from the remainder of the sheet, so that when the covering portion is placed over a toilet seat, the elongated oval area hangs down into a toilet bowl and remains connected to the covering section by its distal section.

2. A paper sheet used as a toilet seat cover, comprising:

a. an individual sheet of paper having an interior die cut line which divides the paper sheet into a central portion within the die-cut line and an outer seat covering portion;

b. said central portion comprises a body area and a distal section, with a pair of spaced apart finger holes transversely extending through the body area and positioned at a location so that the finger holes are not connected to the die cut line and do not touch the die cut line, with each finger hole not cut in a full 360 degree circle but has a portion retained onto the body area; and c. through use of fingers of a hand, the fingers are inserted into a respective one of the finger holes and used to tear the body area along the die-cut line to separate the body area from the remainder of the sheet, so that when the covering portion is placed over a toilet seat, the body area hangs down into a toilet bowl and remains connected to the covering portion by its distal section.

3. A toilet seat cover in accordance with claim 2, wherein the two finger holes are symmetrically located within the body area along an imaginary longitudinal centerline of the body area.

4. A toilet seat cover in accordance with claim 2, wherein said pair of finger holes are located at any location of the body area so as not to touch the die-cut line.

5. A paper sheet used as a toilet seat cover, comprising:

a. an individual sheet of paper having an interior die cut line which divides the paper sheet into a central portion within the die-cut line and an outer seat covering portion;

b. said central portion comprises a body area and a distal section, with at least one finger hole transversely extending through the body area and positioned at a location so that the finger holes are not connected to the die cut line and do not touch the die cut line, with the at least one finger hole not cut in a full 360 degree circle but having a portion retained onto the body area; and c. through use of a finger of a hand, the finger is inserted into the at least one finger hole and used to tear the body area along the die-cut line to separate the body area from the remainder of the sheet, so that when the covering portion is placed over a toilet seat, the body area hangs down into a toilet bowl and remains connected to the covering section by its distal section.

6. A toilet seat cover in accordance with claim 5 wherein the at least one finger hole is located within the body area along an imaginary longitudinal centerline of the body area.

7. A toilet seat cover in accordance with claim 5 wherein the at least one finger hole is at any location of the body area so as not to touch the die-cut line.

* * * * *